US005355750A

United States Patent [19]

Scott et al.

[11] Patent Number: 5,355,750

[45] Date of Patent: Oct. 18, 1994

[54] ROLLING CONE BIT WITH IMPROVED WEAR RESISTANT INSERTS

[75] Inventors: Danny E. Scott, Houston, Tex.; Redd H. Smith; Gordon A. Tibbitts, both of Salt Lake City, Utah

[73] Assignee: Baker Hughes Incorporated, Houston, Tex.

[21] Appl. No.: 159,009

[22] Filed: Nov. 29, 1993

Related U.S. Application Data

[60] Division of Ser. No. 895,594, Jun. 8, 1992, which is a continuation-in-part of Ser. No. 662,935, Mar. 1, 1991, Pat. No. 5,119,714.

[51] Int. Cl.[5] ..... B21K 5/02

[52] U.S. Cl. ..... 76/108.2; 264/60; 264/67; 51/293; 51/309; 76/DIG. 11; 76/DIG. 12

[58] Field of Search ..... 76/108.2, 108.1, 108.4, 76/DIG. 11, DIG. 12; 264/60, 67; 51/293, 309, 307

[56] References Cited

U.S. PATENT DOCUMENTS

| | | |
|---|---|---|
| 4,109,737 | 8/1978 | Bovenkerk . |
| 4,140,189 | 2/1979 | Garner . |
| 4,148,368 | 4/1979 | Evans . |
| 4,164,527 | 8/1979 | Bakul et al. . |
| 4,203,496 | 5/1980 | Baker, III et al. . |
| 4,221,270 | 9/1980 | Vezirian . |
| 4,255,165 | 3/1981 | Dennis et al. . |
| 4,268,276 | 5/1981 | Bovenkeik . |
| 4,373,593 | 2/1983 | Phaal et al. . |
| 4,431,065 | 2/1984 | Andrews . |
| 4,457,765 | 7/1984 | Wilson . |
| 4,525,178 | 6/1985 | Hall . |
| 4,604,106 | 8/1986 | Hall et al. . |
| 4,694,918 | 9/1987 | Hall . |
| 4,764,255 | 8/1988 | Fischer et al. . |
| 4,943,488 | 7/1990 | Sung et al. . |
| 5,000,273 | 3/1991 | Horton et al. . |
| 5,045,092 | 9/1991 | Keshavan . |
| 5,049,164 | 9/1991 | Horton et al. . |
| 5,159,857 | 11/1992 | Jurewicz ..... 76/DIG. 11 |

*Primary Examiner*—Roscoe V. Parker

*Attorney, Agent, or Firm*—Robert A. Felsman; Mark D. Perdue

[57] ABSTRACT

An improved earth-boring bit the rolling cone variety and an insert for use therein is provided. A superabrasive element is coated with at least one layer of metallic material. The superabrasive element then is placed in a receptacle cavity in a pre-formed hard metal jacket. The superabrasive element then is brazed or infiltrated to the hard metal jacket. Metallurgical and mechanical bonds between the superabrasive element, the at least one layer of metallic material on superabrasive element, the braze or infiltrant binder material, and the fracture-tough material of the hard metal jacket retain the superabrasive element in the cavity of the hard metal jacket. Improved earth-boring bits according to this embodiment of the present invention provide abrasion-resistant earth-boring bits of the rolling cutter variety. Such improved bits, and the inserts therefore, are formed without resort to high-temperature, high-pressure processes.

16 Claims, 7 Drawing Sheets

ROLLING CONE BIT WITH IMPROVED WEAR RESISTANT INSERTS

CROSS-REFERENCE TO RELATED APPLICATIONS

This application is a division of application Ser. No. 07/895,594, filed Jun. 8, 1992 which is a continuation-in-part of the co-pending application of Danny E. Scott and Stephen R. Jurewicz, entitled ROTARY ROCK BIT WITH IMPROVED DIAMOND FILLED COMPACTS, application Ser. No. 07/662,935, filed Mar. 1, 1991 and now U.S. Pat. No. 5,119,714. This application is related to the co-pending application of Danny Eugene Scott and Stephen R. Jurewicz, entitled IMPROVED ROCK BIT COMPACT AND METHOD OF MANUFACTURE, Ser. No. 07/663,266, filed Mar. 1, 1991 and now U.S. Pat. No. 5,173,090, and the co-pending divisional application of Danny Eugene Scott and Stephen R. Jurewicz entitled ROTARY ROCK BIT WITH IMPROVED DIAMOND FILLED COMPACTS, Ser. No. 07/881,731,filed May 7, 1992, and now U.S. Pat. No. 5,248,006.

BACKGROUND OF THE INVENTION

1. Field of the Invention

The present invention relates generally to earth-boring bits of the rolling cutter type and to improvements in gage and heel row compacts for such bits by which the resistance to wear is increased, the improved compacts being formed with a hard metal jacket and a superabrasive working surface.

2. Description of the Prior Art

Wear-resistant inserts or compacts are utilized in a variety of earth-boring tools where the inserts form rock cutting, crushing, chipping or abrading elements. In rotary well drilling, some geological formations are drilled with bits having cutting structures of wear-resistant (usually sintered tungsten carbide) compacts held in receiving apertures in rotatable cones. In such bits, there is usually on each cone a group of cylindrical compacts that define a circumferential heel row that removes earth at the corner of the bore hole bottom. Further, it is common to insert additional cylindrical compacts, called "gage" compacts, on a "gage" surface that intersects a generally conical surface that receives the heel row compacts. These gage compacts protect the gage surfaces to prevent erosion of the metal of the cones that supports the heel row compacts. As a result, fewer heel compacts are lost during drilling and the original diameter of the bit is better maintained due to decreased wear. Moreover, the gage compacts also ream the hole to full "gage" after the heel compacts are worn to an undersized condition.

Fixed cutter bits, either steel-bodied or matrix, are also utilized in drilling certain types of geological formations effectively. While these bits do not feature rotatable cones, they also have wear-resistant inserts advantageously positioned in the "shoulder" or "gage" regions on the face of the bit which are essential to prolong the useful life of the bit.

A typical prior-art wear-resistant insert was manufactured of sintered tungsten carbide, a composition of mono and/or ditungsten carbide cemented with a binder typically selected from the iron group, consisting of cobalt, nickel or iron. Cobalt generally ranged from about 6 to 16% of the binder, the balance being tungsten carbide. The exact composition depended upon the usage intended for the tool and its inserts.

In recent years, both natural and synthetic diamonds and other superabrasive materials have been used, in addition to tungsten carbide compacts, as cutting inserts on rotary and fixed cutter rock bits. In fact, it has long been recognized that tungsten carbide as a matrix for superabrasives has the advantage that the carbide itself is wear-resistant, fracture-tough, and offers prolonged matrix life. U.S. Pat. No. 1,939,991 describes a diamond cutting tool utilizing inserts formed of diamonds held in a medium such as tungsten carbide mixed with a binder of iron, cobalt, or nickel.

In some prior-art cutting tools, the superabrasive component of the tool was formed by the conversion of graphite to diamond. U.S. Pat. No. 3,850,053 describes a technique for making cutting tool blanks by placing a graphite disk in contact with a cemented tungsten carbide cylinder and exposing both simultaneously to diamond forming temperatures and pressures. U.S. Pat. No. 4,259,090 describes a technique for making a cylindrical mass of polycrystalline diamond by loading a mass of graphite into a cup-shaped container made from tungsten carbide and diamond catalyst material. The loaded assembly is then placed in a high temperature and pressure apparatus where the graphite is converted to diamond. U.S. Pat. No. 4,525,178 shows a composite material which includes a mixture of individual diamond crystals and pieces of precemented carbide.

U.S. Pat. No. 4,148,368 shows a tungsten carbide insert for mounting in a rolling cone cutter which includes a diamond insert embedded in a portion of the work surface of the tungsten carbide cutting insert in order to improve the wear resistance thereof. Various other prior art techniques have been attempted in which a natural or synthetic diamond insert was utilized. For instance, there have been attempts in the prior art to press-fit a natural or synthetic diamond within a jacket, with the intention being to engage the jacket containing the diamond within an insert receiving opening provided on the bit face or cone. These attempts were not generally successful since the diamonds tended to fracture or become dislodged in use.

This lack of success is attributable to the boring mechanics of rolling cone bits. Unlike other applications for superabrasives, inserts used in rolling cone bits are subjected to extreme transient, or shock, force loads during drilling. Superabrasives are generally extremely hard but extremely brittle, and cannot withstand extreme transient loads without cracking or other brittle failure. It is believed that such brittle failure can be avoided by securing the superabrasive to a substrate formed of a fracture-tough material. The fracture-tough material then can absorb the shock loads that the superabrasive is incapable of withstanding alone.

Provision of a superabrasive with a fracture-tough, shock-absorbing substrate does not provide the final solution: there remains the problem of retention of the superabrasive on the substrate. U.S. Pat. No. 4,148,368 discloses a diamond insert imbedded in a fracture-tough insert to be interference fit into a rolling cone cutter of an earth-boring bit. That disclosure suggests that the diamond be affixed to the remainder of the insert by an interference fit or brazing. Interference fitting of a diamond into a insert, with the insert, in turn, interference fit into a socket on a rolling cone is unsatisfactory because the diamond is incapable of withstanding the residual stress of the initial and subsequent interference fits upon exposure to the transient force loads of drilling.

Simply brazing a diamond or other superabrasive also is unsatisfactory. Diamonds, as well as other superabrasives, often contain impurities in their crystal lattices that render the materials thermally unstable; that is, subject to cracking and other deformation and decomposition upon heating. Additionally, superabrasives have among the lowest coefficients of thermal expansion of known materials. Therefore, upon the heating and cooling present in brazing operations, a superabrasive will expand and shrink less than most any material to which it may be brazed and the braze material itself. The different shrinking rates of superabrasives and the substrate and braze materials cause residual thermal stresses in the superabrasive that can cause the superabrasive to crack upon cooling, or upon exposure to the transient loading of drilling.

The former problem largely has been solved by the relatively recent development of TS (thermally or temperature-stable) grades of superabrasives. These TS superabrasives are processed to remove the impurities that cause cracking upon heating of the superabrasives. However, the latter problem still remains an obstacle to brazing or infiltrating superabrasives to a fracture-tough substrate.

Still further, brazing a superabrasive element alone yields unsatisfactory results apart from thermal decomposition and deformation problems. Braze materials appear to be incapable of wetting or otherwise succesfully bonding to the surfaces of superabrasive elements. Thus, the retentive strength of brazed superabrasives is limited to the shear strength of the braze material, which generally is low and certainly incapable of withstanding forces encountered by rolling cone earth-boring bits in drilling operation.

Other solutions have been attempted. U.S. Pat. No. 4,604,106 discloses a compact for use in earth-boring bits having diamond particles sintered with cemented carbide particles to form a composite insert. Such an insert is unsatisfactory, however, because its wear resistance is limited to that of the cemented carbide that binds the particles together: at the working surface of such an insert a substantial amount of cemented carbide is exposed along with the diamond particles. Such an insert does not exhibit the wear-resistant properties of an insert having a working surface comprising entirely or primarily superabrasive. It is at least theoretically possible to form such a composite insert having a working surface primarily of diamond, but the extremely high-pressure sintering and pressing processes required to form such an insert are extraordinarily expensive.

U.S. Pat. No. 4,493,488 discloses superabrasive inserts affixed to fracture-tough substrates for use in fixed cutter, or drag bits. U.S. Pat. No. 5,049,164 discloses another superabrasive insert having a superabrasive affixed to a fracture-tough substrate, for use in fixed cutter, or drag bits. The inserts disclosed are not adapted for the rigorous environment encountered by rolling-cone earth-boring bits.

There continues to exist a need for improvements in compacts of the type utilized as wear-resistant inserts in earth-boring bits, particularly in the gage and heel regions of rolling cone bits, which will improve the useful life of such bits.

A need also exists for improvements in the wear-resistant inserts used in such bits, whereby such inserts are provided with improved abrasion resistance and diamond retention characteristics.

It is advantageous, therefore, to provide an insert for use in an earth-boring bit of the rolling cone variety having an abrasion-resistant working surface formed primarily of a superabrasive, such as polycrystalline diamond, which is affixed to a fracture-tough substrate by a relatively low-cost, low pressure and temperature process.

SUMMARY OF THE INVENTION

The improved rolling cone bits of the invention utilize superabrasive compacts as wear-resistant inserts on the rotatable cones thereof. The superabrasive compacts have outer, generally cylindrical hard metal jackets and an inner core of superabrasive material, such as polycrystalline diamond or cubic boron nitride. The compacts also preferably have an exposed, top surface, at least a majority of which is exposed superabrasive. The superabrasive is not utilized to strengthen or reinforce a tungsten carbide work surface, but instead substantially makes up the work surface itself.

In one embodiment, the compacts are manufactured by placing a diamond powder within a hard metal jacket provided as either a cup or cylinder. The loaded jacket is then capped and placed into a high temperature and pressure apparatus and exposed to diamond sintering conditions to sinter the diamond grains into a raw blank comprised of a core of integrally formed polycrystalline diamond surrounded by the hard metal jacket. The resulting blank can then be removed from the apparatus and shaped to form a compact having a variety of cutting forms.

Preferably, a generally cylindrical, hard metal jacket is provided having at least one initially open end and an open interior. The open interior preferably has an internal diameter which is at least 5% greater than the final required diameter. The cylindrical jacket also has an initial thickness which is preferably twice as thick as the final thickness required for the finished compact. The interior of the jacket is substantially filled with diamond powder and the initially open end of the jacket is covered with a cap. The diamond filled jacket is then subjected to a temperature and pressure sufficient to sinter the diamond powder. The outer diameter of the jacket is then reduced by finally sizing the outer diameter to a size selected to conform to the cutting insert pocket provided on the drill bit. By utilizing the compacts in insert receiving pockets provided in the gage row of the rotatable cutter, resistance to gage wear is increased and the useful life of the bit is increased.

In another embodiment, a superabrasive element is coated with at least one layer of metallic material. The element then is placed in a receptacle cavity in a preformed hard metal jacket. The superabrasive element then is brazed or infiltrated to the hard metal jacket. Metallurgical and mechanical bonds between the superabrasive element, the at least one layer of metallic material on superabrasive element, the braze or infiltrant binder material, and the fracture-tough material of the hard metal jacket retain the superabrasive element in the cavity of the hard metal jacket. Improved compacts formed according to this embodiment of the present invention provide abrasion-resistant inserts for use in earth-boring bits of the rolling cutter variety. Such improved inserts are formed without resort to high-temperature, high-pressure processes. An earth-boring bit provided with inserts according to the present invention has improved wear-resistance and ability to maintain the gage diameter of the borehole.

Additional objects, features and advantages will be apparent in the written description which follows.

DETAILED DESCRIPTION OF THE INVENTION

Figure 1:
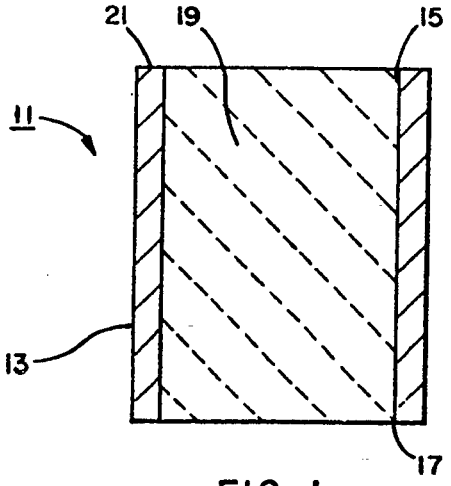
FIG. 1 is a side, cross-sectional view of an improved compact used in the earth-boring bit of the invention prior to shaping or chamfering, the compact having oppositely arranged, exposed diamond surfaces.
Figure 2:
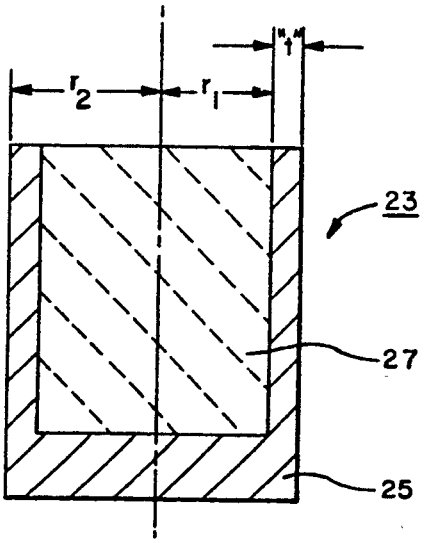
FIG. 2 is a cross-sectional view similar to FIG. 1 of a compact having an extra base layer of metal and an oppositely arranged, exposed diamond surface.

FIGS. 1 and 2 are cross-sectional views of raw blanks of the type which can be shaped to form, for instance, gage, heel and inner row compacts used in the practice of the invention. The blank 11 shown in FIG. 1 includes an outer, generally cylindrical jacket 13 which, in this case, has initially open ends 15, 17. Preferably, the jacket 13 is formed of a suitable metal or sintered carbide which will be referred to as a "hard metal jacket" for purposes of this description.

Although a sintered carbide, such as tungsten carbide is the preferred hard metal for the jacket material, it will be understood that other carbides, metals and metal alloys can be utilized as well. For instance, other possible jacket materials include INVAR, cobalt alloys, silicon carbide alloys and the like. As will be further explained, the purpose of the jacket 13 in the present method is to facilitate later machining and shaping of the compact and to facilitate insertion of the compact into a cutting insert pocket on a drill bit. Since the jacket 13 is not the primary work surface of the compact, it is not a requirement of the present invention that the jacket be formed of tungsten carbide.

The compact 11 has an inner core 19 of polycrystalline diamond, or other superabrasive material such as cubic boron nitride. The compact has a top surface 21, which comprises the work surface of the compact, at least a majority of which is exposed superabrasive material. As will be explained, the superabrasive material core 19 may be formed by filling the hard metal jacket 13 with a diamond powder and by sintering the diamond in a high-pressure high-temperature apparatus for a time and to a temperature sufficient to sinter the diamond and integrally form the diamond core within the jacket 13. As will be explained further in the description which follows, the superabrasive core 19 may also be formed by coating a superabrasive element with at least one layer of metallic material and brazing or infiltrating a binder material to retain the core 19 in the jacket 13 by a combination of mechanical and metallurgical bonds.

The compact blank 23 of FIG. 2 is identical to the blank of FIG. 1 except that an additional layer of hard metal 25 is added to the base of the compact to give the compact a cup-like appearance and to provide room for additional machining during later shaping operations. In both cases, the cylindrical diamond core 27 has a radius "$r_1$" surrounded by a jacket having cylindrical sidewalls of a generally uniform thickness "t", the jacket having a radius "$r_2$." The thickness of the jacket sidewalls "t" is preferably no greater than ½ the radius "$r_1$" of the cylindrical diamond core 19.

Figure 3:
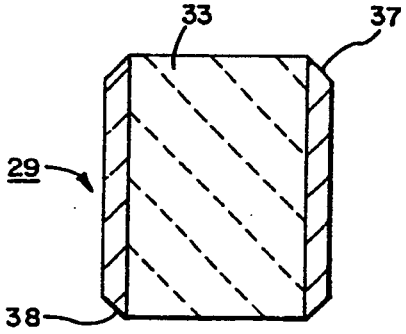
FIG. 3 is a cross-sectional view similar to FIG. 1 showing a gage compact with oppositely exposed diamond surfaces.
Figure 4:
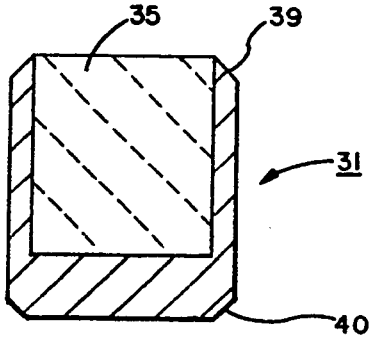
FIG. 4 is a view similar to FIG. 2 showing a gage compact with only one exposed diamond surface.

The compact blanks shown in FIGS. 1 and 2 can be shaped to form a variety of wear-resistant inserts useful in earth-boring tools. For instance, FIGS. 3 and 4 are cross-sectional views of gage row compacts formed by suitably shaping the blanks of FIGS. 1 and 2. The gage row compacts are characterized by flat, exposed superabrasive surfaces 33, 35 and also have chamfered top and bottom edges 37, 39 and 38, 40, respectively.

Figure 5:
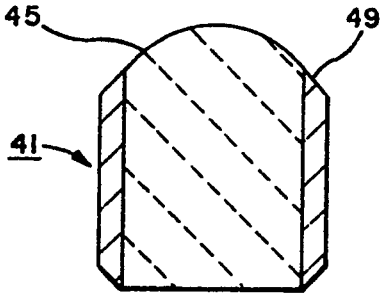
FIGS. 5–6 are similar to FIGS. 1–2 but illustrate heel row compacts having shaped upper extents.
Figure 6:
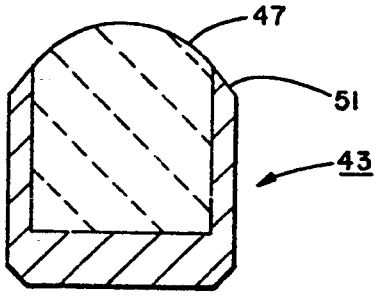

FIGS. 5 and 6 illustrate heel row compacts 41, 43 which feature generally arcuate upper extents 45, 47 and chamfered upper edges 49, 51.

Figure 7:
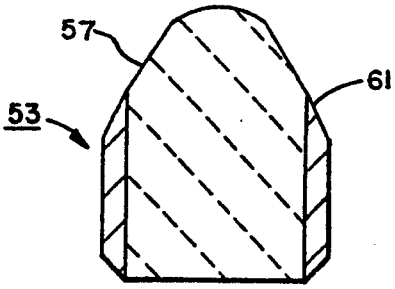
FIGS. 7–8 are similar to FIGS. 1–2 but show inner row compacts having shaped upper extents.
Figure 8:
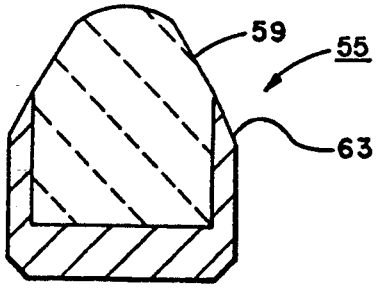

FIGS. 7 and 8 show inner row compacts 53, 55 which also feature chisel-shaped upper exposed superabrasive extents 57, 59 and chamfered top edges 61, 63.

Figure 11:
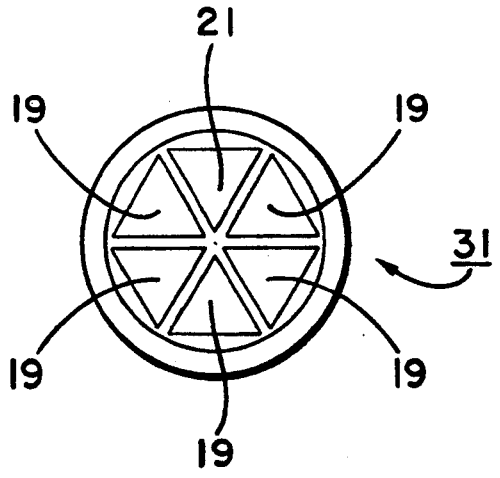
FIGS. 9, 10, and 11 illustrate the upper or working surfaces of gage row compacts as in FIG. 4.
Figure 10:
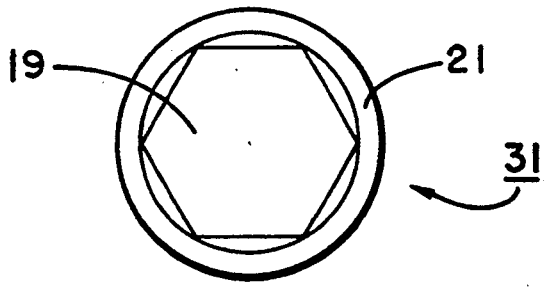
Figure 9:
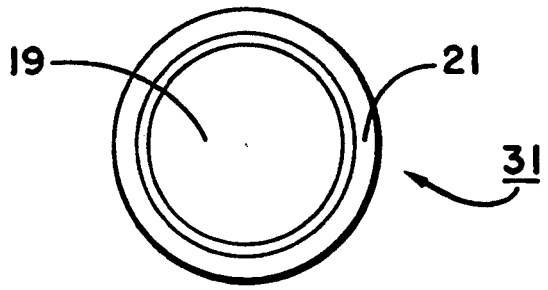

FIGS. 9, 10, and 11 are plan views of the top or working surfaces 21 of gage row compacts 31. FIG. 9 illustrates a preferred embodiment in which the working surface 21 of gage row insert 31 comprises a circular area. The superabrasive insert 19 in this case is a commercially available disk of generally cylindrical configuration. A circular superabrasive working surface 21 maximizes exposed superabrasive and the wear-resistance of the gage row compact 31.

FIG. 10 depicts the top or working surface 21 of a gage row compact 31 having a single hexagonally shaped superabrasive element retained thereon. Hexagonally shaped superabrasive elements 19 are commercially available and may provide an advantageous wear-resistant surface in particular cutting conditions.

FIG. 11 illustrates an embodiment in which the working surface 21 of gage row insert 31 comprises a plurality of geometrically shaped, in this case six triangular, superabrasive elements 19. Triangular elements 19 are a commercially available shape, and may provide advantageous wear-resistant surface geometry in some applications.

Figure 12:
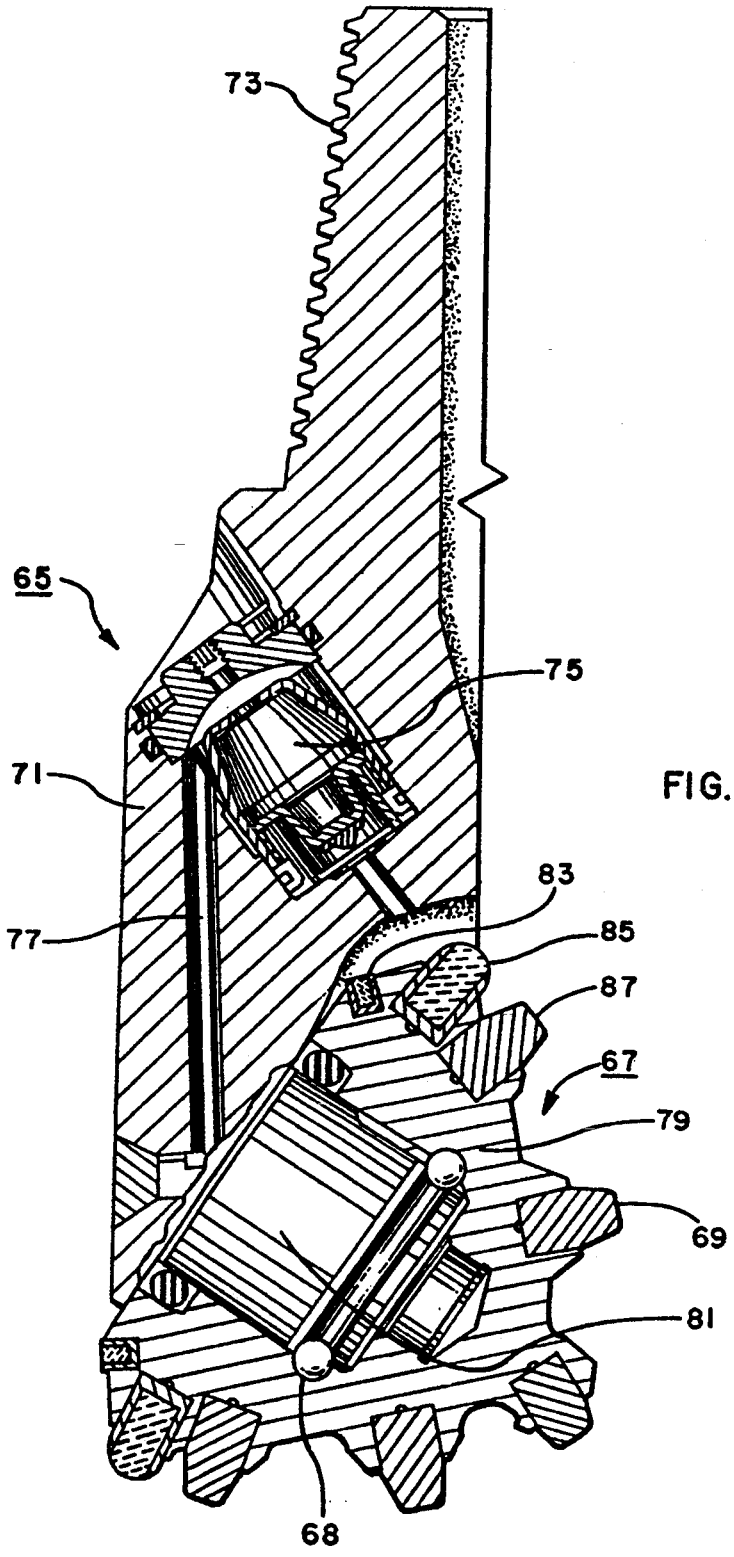
FIG. 12 is a side, partial cross-sectional view of a rolling cone rock bit of the type used to drill an earthen formation using the diamond filled compacts.

FIG. 12 is a quarter sectional view of a rolling cone bit 65 typically provided with three rotatable cones, such as cone 67, each mounted on a bearing shaft 81 and having wear-resistant inserts 69 used as earth disintegrating teeth. A bit body 71 has an upper end 73 which is externally threaded to be secured to a drill string member (not shown) used to raise and lower the bit in a well bore and to rotate the bit during drilling. The bit 65 will typically include a lubricating mechanism 75 which transmits a lubricant through one or more internal passages 77 to the internal friction surfaces of the cone 67 and have a retaining means 68 for retaining the cone 67 on the shaft 81.

The wear-resistant inserts 69, which form the earth disintegrating teeth on the rolling cone bit 65, are arranged in circumferential rows, here designated by the numerals 83, 85 and 87, and referred to throughout the remainder of this description as the gage, heel and inner rows, respectively. These inserts were, in the past, typically formed of sintered tungsten carbide. The inserts illustrated as 83 and 85 in FIG. 11 feature the improved compacts of the invention. Typically, such inserts 69 are retained in mating sockets in cone 67 by interference fit, but inserts 69 may also be brazed or otherwise conventionally retained therein.

Two methods are available for forming the wear-resistant inserts used in the earth-boring bits according to the present invention. One method generally involves integrally forming the superabrasive core 19 within hard metal jacket 13 by a high-pressure, high-temperature sintering process. As will become apparent, the high-pressure, high-temperature process is particularly suited for polycrystalline diamond as the superabrasive material.

Another method of forming the wear-resistant inserts for use in earth-boring bits according to the present invention employs retaining preformed superabrasive elements 19 within hard metal jackets 21 by brazing or infiltrating superabrasive element 19 together with hard metal jacket 21.

INTEGRAL FORMATION METHOD

Figure 14:
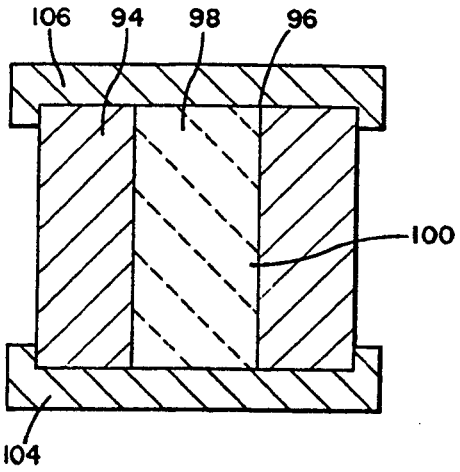
FIG. 14 is an isolated view of a raw blank fitted with end caps in the first step of one method used to form the improved compacts.
Figure 13:
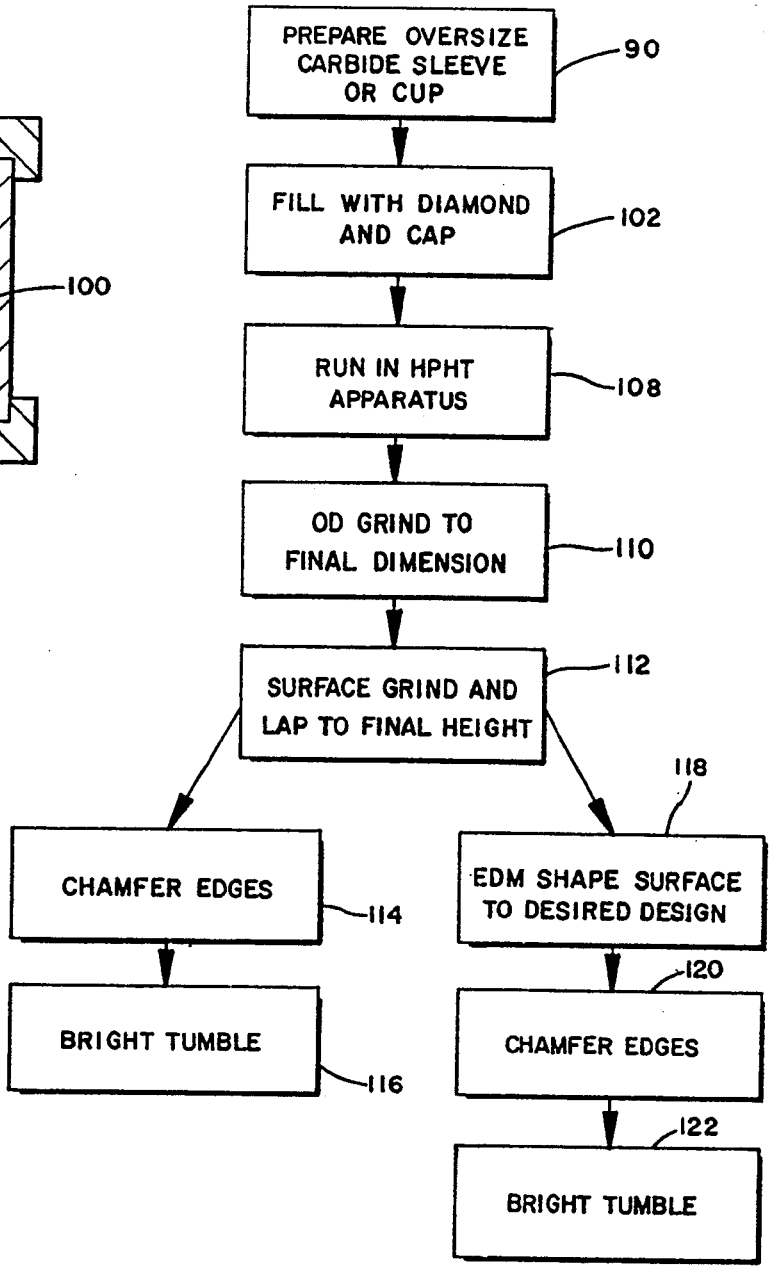
FIG. 13 is a flow diagram illustrating the steps in one method used to form the improved compacts which are used in the earth-boring bits of the invention.

One method of forming the wear-resistant inserts which are used in the drill bits of the invention will now be described with reference to the flow diagram shown in FIG. 13 and with reference to FIG. 143. In the first step of the method, illustrated as 90 in FIG. 13, a hard metal jacket 94 is formed having at least one initially open end 96 and an open interior 98. The open interior (98 in FIG. 14) is generally about 5% larger than the needed for the final dimension. The thickness of the jacket 94 in step 1 is also preferably twice as thick as that required in the final product. The hard metal jacket can conveniently be made from cemented tungsten carbide, other carbides, metals and metal alloys. For instance, the jacket can be formed from INVAR, cobalt alloys, silicon carbide alloys, and the like, as well as refractory metals such as Mo, Co, Nb, Ta, Ti, Zr, W, or alloys thereof.

The open interior 98 of the jacket is then substantially filled with a diamond powder 100 in a step 102. The diamond powder can conveniently be any diamond or diamond containing blend which can be subjected to high pressure and high temperature conditions to sinter the diamond material and integrally form a core of diamond material within the interior 98 of the surrounding jacket 94. For instance, the diamond material can comprise a diamond powder blend formed by blending together diamond powder and a binder selected from the group consisting of Ni, Co, Fe and alloys thereof, the binder being present in the range from about 0 to 10% by weight, based on the total weight of diamond powder blend. A number of diamond powders are commercially available including the GE 300 and GE MBS Series diamond powders provided by General Electric Corporation and the DeBeers SDA Series.

After filling the interior 98 of the hard metal jacket 94 with diamond powder blend, the jacket is fitted with tight fitting end caps 104, 106 and run in a high pressure high temperature apparatus in a step 108. The high pressure and temperature apparatus exposes the loaded jacket 94 to conditions sufficient to sinter the powdered diamond and integrally form a diamond core within a surrounding hard metal jacket.

Ultra high pressure and temperature cells are known in the art and are described, for instance, in U.S. Pat. Nos. 3,913,280 and 3,745,623 and will be familiar to those skilled in the art. These devices are capable of reaching conditions in excess of 40 kilobars pressure and 1,200° C. temperature.

In the next step 110 (FIG. 13) of the manufacturing method, the outside diameter of the hard metal jacket 94 is reduced to a size selected to conform to an insert receiving pocket provided on a drill bit, remembering that the hard metal jacket 94 was initially provided with a thickness preferably twice as thick as that required in the final product.

In the next step of the method 112, the compact is lapped, surface ground or electro discharge ground to provide a smooth top surface on the wear-resistant insert and to achieve the final height desired. It will be understood by those skilled in the art that steps 110 and 112 could be interchanged in order.

For the gage row inserts (illustrated as FIGS. 3 and 4 and 83 in FIG. 12) the next step 114 is to grind the final chamfers on the top and bottom surfaces of the compact followed by bright tumbling in a step 116 to remove any sharp edges. The final gage row compact, as illustrated in FIGS. 3 and 4 has a basically planar top surface which is predominantly of exposed diamond material.

In the case of heel and inner row compacts, the next step after O.D. grinding and surface grinding is to shape the top surface to the desired final configuration in a step 118 using known machining techniques. The preferred shaping technique is Electro Discharge Machining (EDM) and can be used, e.g., to produce a heel row wear-resistant insert having a dome or chisel shape. Standard EDM shaping techniques can be utilized in this step, such as those used in the manufacture of tungsten carbide dies and punches. After EDM shaping, the bottom surface of the compact may be chamfered in a step 120 and the part can be bright tumbled in a step 122 to complete the manufacturing operation. For thermally stable (TS) grades of superabrasives, laser shaping is the preferred technique because thermally stable grades of superabrasive are insufficiently electrically conductive to permit use of EDM shaping.

BRAZE/INFILTRATE METHOD

Figure 15:
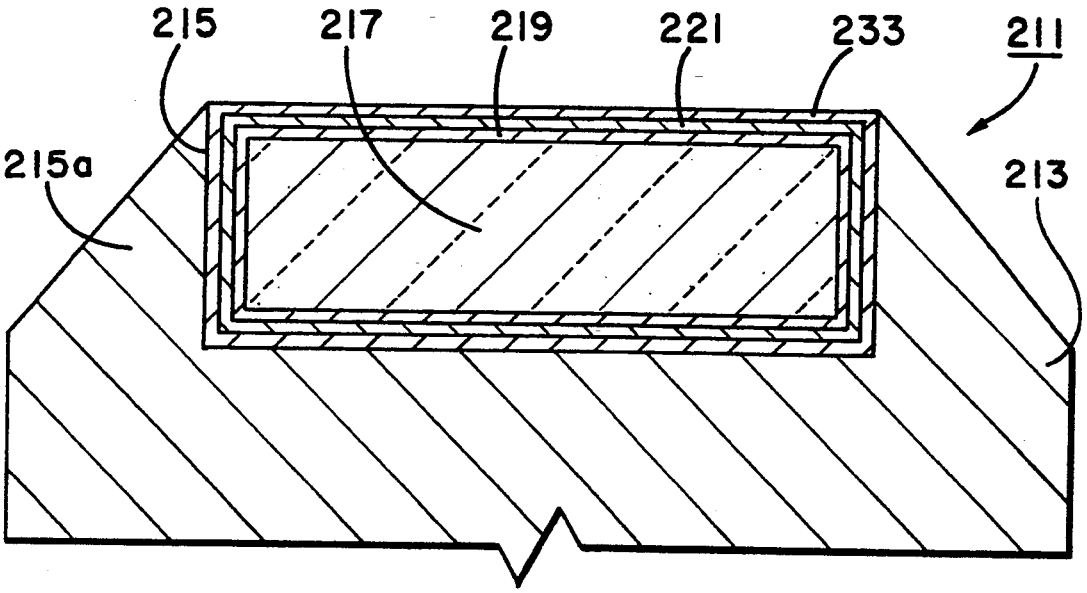
FIG. 15 is a fragmentary elevation section view of a compact according to the present invention.

Referring now to FIG. 15, a compact or insert 211 according to the improved, low-temperature, low-pressure method of the present invention is shown in fragmentary section. Compact 211 includes a hard metal jacket 213 formed of a fracture-tough hard metal. While the material of the hard metal jacket 213 is referred to as "hard metal," the principal property of interest in this material is fracture-toughness. The material of hard metal jacket 213 must possess sufficient fracture-toughness to endure transient or shock loads encountered by earth-boring bits of the rolling cone variety. Such a material may be a traditional hard metal, such as cemented tungsten carbide, or other carbides formed from metals of the groups IVB, VB, VIB, or VIIB. In addition to cemented carbide materials, infiltrated matrix materials comprising carbide or other metallic or ceramic particles forming a matrix with a binder material have been found satisfactory, as well.

An opening is formed in hard metal jacket 213 to define a receptacle cavity 215 having an open end. Receptacle cavity 215 is appropriately dimensioned to receive a superabrasive insert 217. Superabrasive insert 217 is a commercially available element of thermally stable polycrystalline diamond (TSPCD) or cubic boron nitride (TSCBN). Such superabrasive elements are available in a variety of sizes and geometrical shapes from General Electric and DeBeers.

Receptacle cavity 215 should be formed to leave a wall 215*a* of fracture-tough material to surround the peripheral edge of superabrasive element 217 retained therein. Such a surrounding wall 215*a* insulates superabrasive element 217 from transient loading during drilling, thereby preventing rapid degradation of superabrasive material in operation due to brittle failure, heat cracking, or the like. Such an insert structure provides inserts having a working surface, the majority of which is superabrasive, that is extremely wear-resistant, yet is protective of superabrasive element 217.

Superabrasive element 217 is secured in receptacle cavity 215 by brazing or infiltrating a binder material to bond superabrasive element 217 to hard metal jacket 213, in cooperation with the layers of metallic material 219, 221, 223.

Formed on superabrasive element 217 are layers of metallic material 219, 221, 223. In a preferred embodiment of the present invention, the layers of metallic material include an inner layer 219, an intermediate or compliant layer 221, and an outer layer 223. In one preferred embodiment, inner layer 219 and outer layer 223 are tungsten and the compliant layer is copper and nickel. In the preferred embodiment, tungsten is chosen because it is a carbide former and it is a refractory metal having a melting temperature sufficiently high that it will not melt and dissolve, at the temperatures contemplated for the methods described herein, in the other materials described herein. Upon heating, inner layer 219 and TSPCD element 217 may react to form a tungsten carbide chemical bond that may improve bonding between inner layer 219 and TSPCD element 217.

It is believed, however, that the primary bonding mechanism between inner layer 219 and TSPCD element 217 is a mechanical bond employing diffusion of the material of inner layer 219 into the near-surface-porosity of element 217. However, this mechanical bond may be enhanced by a chemical or metallurgical bond between the carbide-forming material of inner layer 219 and TSPCD element 217. If superabrasive element 217 is a TSCBN, inner layer 219 should be selected to be a boride or nitride forming metal. In any case, the material of the inner layer 219 should not be extremely reactive with any of the other materials of the insert 211, to prevent inhibition of the bonding mechanisms described herein. Additionally, the material of the inner layer 219 should have a higher melting temperature than compliant layer 221 to prevent the material from dissolving in the other layers of metallic coatings formed on superabrasive element 217.

Inner layer 219 is followed by an intermediate or compliant layer 221. Compliant layer 221 is formed of a ductile metal and serves to redistribute and dissipate residual thermal stresses resulting from different rates of thermal expansion of superabrasive element 217 and hard metal jacket 213. The metal of compliant layer 221 should also be selected to have limited solubility with the materials of inner layer 219 and outer layer 223. If the metal of compliant layer 221 is of limited solubility in inner layer 219 and outer layer 223, inner layer 219 and outer layer 223 will be wet by compliant layer 221 without the metal of compliant layer 221 becoming completely dissolved therein. This partial solubility results in a metallurgical bond (as contrasted with a mechanical bond) between compliant layer 221, inner layer 219, and outer layer 223.

According to a preferred embodiment of the invention, compliant layer 221 comprises a first layer of nickel, a second layer of copper, and a third layer of nickel. The layer of copper provides the ductility necessary to redistribute residual thermal stresses from superabrasive element 217, and the layers of nickel provide the partial solubility necessary to achieve the metallurgical bond between compliant layer 221, inner layer 219, and outer layer 223. Further, nickel and copper are completely soluble in each other, and will form a strong metallurgical bond with each other. Copper alone is insoluble in tungsten and other refractory metals, and therefore could not be used alone as the compliant layer 221.

Compliant layer 221 is followed by an outer layer 223 of metallic material. The material of outer layer 221 is selected to be compatible with both the fracture-tough material of the hard metal jacket and the binder material (braze or infiltrant) used to bond superabrasive element 217 to the fracture-tough material of hard metal jacket 213. The material of outer layer should not be excessively reactive with the fracture-tough material, and should be capable of being wet by the binder material to provide a metallurgical (as contrasted with mechanical) bond between the fracture-tough material of hard metal jacket 213 and outer layer 221.

According to the preferred embodiment of the present invention, outer layer 223 is tungsten. Tungsten clearly is compatible with the preferred tungsten carbide material of the hard metal jacket 213, and is wet by most conventional brazes and infiltrants. Further, the material of outer layer 223 should be partially soluble in the material of compliant layer 221 to form a metallurgical bond as discussed with reference to the bond between inner layer 219 and compliant layer 221, above. Additionally, the material of outer layer 223 should be selected to have a melting temperature higher than that of compliant layer 221 and binder material to prevent dissolution of outer layer 223 therein.

While the three-layered structure described herein provides satisfactory retention of superabrasive 217 in hard metal jacket 213 in most every case, it has been found that fewer coatings are satisfactory in some cases. For superabrasive elements 217 having large mass, the presence of a compliant layer 221 is a virtual necessity to prevent deformation of element 217 during brazing or infiltration operations. However, for superabrasive elements 217 having small mass (on the order of less than one-third of one carat), and particularly the triangular elements (discussed above with reference to FIG. 11), it has been found that a single coating of a refractory metal, substantially as described with reference to inner layer 219, above, permits satisfactory retention of superabrasive element 217 in receptacle cavity 215 of hard metal jacket 213.

It is possible that these smaller elements 217 and their receptacle cavities 215 do not achieve a differential rate of shrinkage sufficient to damage the elements. Alternatively, the geometry of the smaller elements may prevent failure of element 217 if stresses resulting from differential shrinkage occur. In any case, however, smaller superabrasive elements having mass less than approximately one-third of a carat may be coated only with inner layer 219 to achieve satisfactory results. A single layer is substantially identical to inner layer 219 and outer layer 223 in its dimensions, material, and bonding characteristics.

While the layers of metallic material 219, 221, 223 are illustrated as completely surrounding and enclosing superabrasive 217, it will be appreciated that the layers 219, 221, 223 need only cover a portion of superabrasive element 217 necessary to provide the requisite bonding area. Preferably, the layers of metallic material 219, 221, 223 (or 219 alone) will at least cover the lower surface and edges of superabrasive element 217, which are immediately adjacent the walls of receptacle cavity 215 formed in hard metal jacket 213.

It should also be noted that the term "metallurgical bond" is used in contradistinction to the term "mechanical bond." Metallurgical bonds are intended to encompass the various forms of chemical bonding encountered between generally metallic elements and compounds, including covalent bonds, ionic bonds, metallic bonds, and combinations thereof. Use of the term metallurgical bond indicates that it is believed that the primary bonding mechanism is chemical rather than mechanical.

With reference now to FIGS. 16 through 20, the methods employed to obtain a compact 211 as disclosed above with reference to FIG. 15, will be discussed. As a preliminary step to each of the methods disclosed herein, superabrasive element 217 is coated with the aforementioned layers of metallic material 219, 221, 223. The method of coating superabrasive element 217 is dependent upon the material used. Such coating procedures are conventional and well-known in the art. Among the coating methods useful in the present invention are chemical vapor deposition (CVD), metal vapor deposition (MVD), electroplate deposition, and electroless deposition.

Chemical vapor deposition is conventional and involves the dissociation of a metallic compound into a vapor phase and subsequent deposition of the metal onto superabrasive element 217. Metal vapor deposition is conventional and involves heating a metal into a vapor phase and subsequent deposition of metal from the vapor phase onto superabrasive element 217. Electroplate deposition is conventional and involves placing superabrasive element 217 into an electrolytic solution of the metal to be deposited in contact with an anode. Superabrasive element 217 is placed in contact with a cathode. A voltage differential between the anode and cathode drives the deposition. Electroless deposition is conventional and involves placing superabrasive element 217 in a strongly anionic electrolytic solution of the metal to be deposited. Naturally present ionic forces drive the metal deposition. Other deposition techniques, such as sputtering or the like, may be useful.

Some of these deposition methods are more preferable than others. For instance, the choice between CVD and MVD is dependent upon the vapor pressure of the metal. For metals having low vapor pressures, CVD permits higher deposition rates at lower process temperatures. Metals having higher vapor pressures can be deposited rapidly at relatively low temperatures using MVD. Electroplate and electroless techniques generally are much less expensive than either CVD or MVD techniques. However, the metal to be deposited must be readily dissolvable into an electrolytic solution. Electroplate deposition is easier to control than electroless deposition, and tends to produce more uniform coatings.

According to the preferred embodiment of the invention, inner layer 219 of tungsten is deposited using CVD techniques. CVD is chosen because tungsten has a relatively low vapor pressure, and therefore can be deposited at high rates without high process temperatures. The tungsten is deposited until a thickness of ten to twenty microns is achieved. Ten microns is thought to be a minimum thickness in order to permit the tungsten to penetrate into the naturally occurring near-surface porosity of superabrasive element 217. A thickness no greater than twenty microns is preferred.

The foregoing description of the method of depositing inner layer 219 applies equally whether inner layer 219 is to be followed by other layers, or is to stand alone, as in the case of a smaller superabrasive element 217.

Compliant layer 221 is deposited using electroplate deposition. Electroplate deposition is employed because electrolytic solutions of nickel and copper are formed easily and readily available. As previously disclosed, compliant layer 221 comprises a layer of nickel, an intermediate layer of copper, and a outer layer of nickel. Preferably, the nickel layers are approximately three microns thick. A thickness of three microns provides sufficient nickel to wet inner tungsten layer 219 and outer tungsten layer 223. A nickel layer thickness of greater than three microns may alloy in solid solution with the copper layer, thus reducing the ductility of compliant layer 221. Preferably, the copper layer is sufficiently thick to produce an overall compliant layer 221 thickness of substantially twenty to fifty microns. A compliant layer 221 thickness of substantially less than twenty microns will not provide enough ductile material to redistribute a sufficient quantity of residual thermal stress from superabrasive element 217. A compliant layer 221 thickness of substantially fifty microns is preferred.

According to the preferred embodiment of the present invention, outer layer 223 is tungsten, deposited using CVD techniques. Similarly to inner layer 219, outer layer 221 is preferably between ten to twenty microns thick. Thinner coatings may permit binder material to penetrate outer layer 223, thereby alloying with compliant layer 221 and degrading its ductility.

Figure 18:
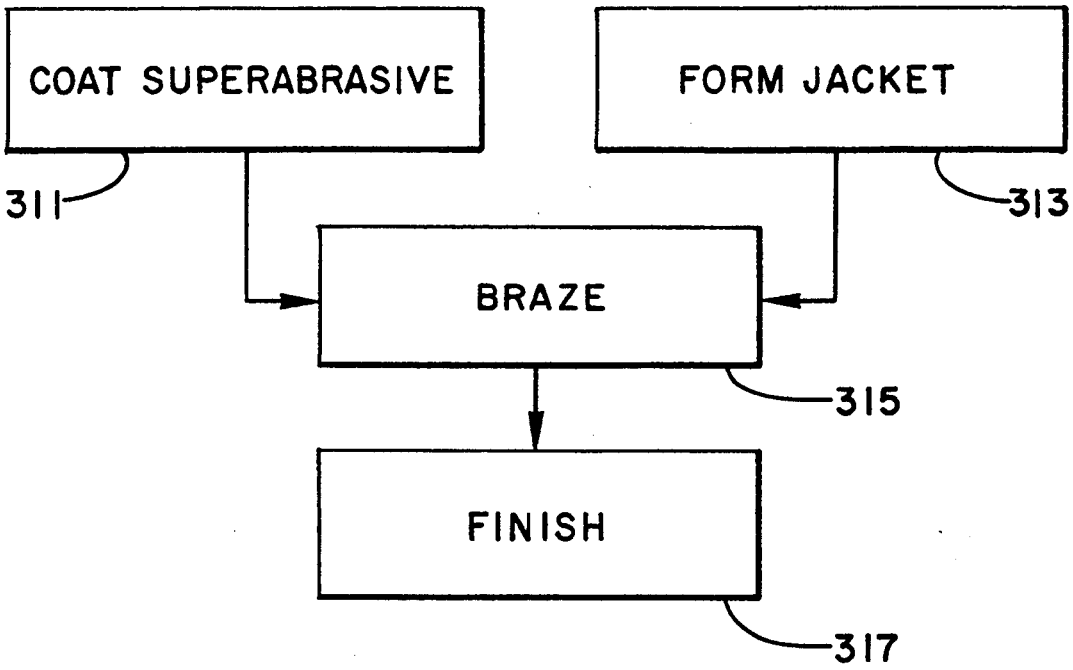
FIG. 18 is a flow diagram illustrating the steps in one method used to form the improved compacts which are used in the earth-boring bits of the invention.

FIG. 18 is a flow diagram depicting one preferred method of forming an insert according to the present invention. Preliminary steps of the method, represented by blocks 311 and 313, are to coat superabrasive element 217, and to form hard metal jacket 213. The coating step is accomplished as disclosed above.

The hard metal jacket may be formed in a variety of ways. Preferably, hard metal jacket 213 is formed of sintered tungsten carbide and cobalt-nickel, cobalt-iron, or cobalts-iron-nickel material. Hard metal jacket 213 may be formed of any fracture-tough material that is suitable for the particular application of the insert 211. Preferably, the jacket is initially generally cylindrical and has a generally cylindrical receptacle cavity 215 formed therein to receive superabrasive insert 217. Receptacle cavity 215 need not be cylindrical, but should be dimensioned to receive the shape of superabrasive insert 217.

Receptacle cavity 215 may be formed in hard metal jacket 213 in a number of ways. If hard metal jacket 213 is formed of sintered tungsten carbide, receptacle cavity 215 may be formed during the sintering process. Otherwise, receptacle cavity 215 may be bored, reamed, ground, or otherwise conventionally formed in a manner appropriate for the fracture-tough material of hard metal jacket 213.

Block 315 represents the next step of the preferred method schematically represented in FIG. 18. After formation of hard metal jacket 213, and the coating of superabrasive element 211, coated superabrasive element 217 is placed in receptacle cavity of hard metal jacket 213. Coated superabrasive element 217 then is brazed to receptacle cavity 215 of hard metal jacket 213. The brazing step is conventional and employs conventional brazing alloys. However, the brazing temperature should not exceed either the maximum temperature of thermal stability of superabrasive element 217, or the melting temperature of the metal(s) chosen for compliant layer 221. The braze temperature should not exceed the maximum temperature of thermal stability of superabrasive element 217 to avoid decomposition of the element. The brazing temperature should not exceed the melting temperature of the metal(s) of compliant layer 221 to avoid the melting and subsequent migration, as well as the alloying, of compliant layer 221. Of course, if only inner layer 219 is used (as in the case of smaller superabrasive elements 217) the brazing temperature need only not exceed the maximum temperature of thermal stability of element 217. According to the preferred embodiment of the present invention, a conventional, low-temperature, silver alloy braze was used as the binder material for the materials above.

The final step of the method of FIG. 18, represented by Block 317, is to finish insert 211. Finishing operations are performed to obtain an insert 211 of proper final dimension and geometry. Such finishing operations include those discussed with reference to FIG. 13, above.

Figure 16:
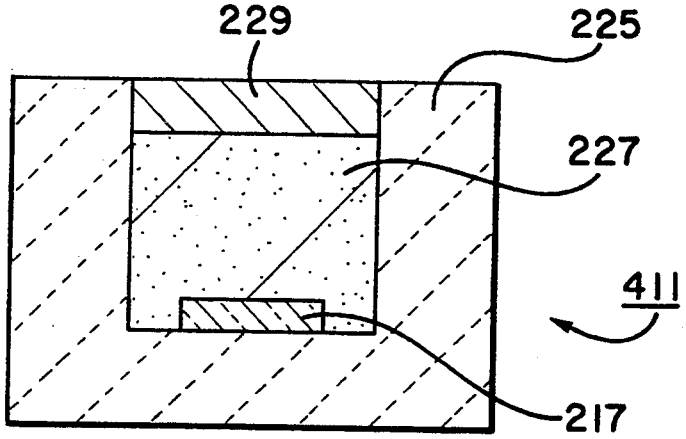
FIG. 16 is a schematic section view of an apparatus used to form compacts according to one embodiment of the invention.
Figure 19:
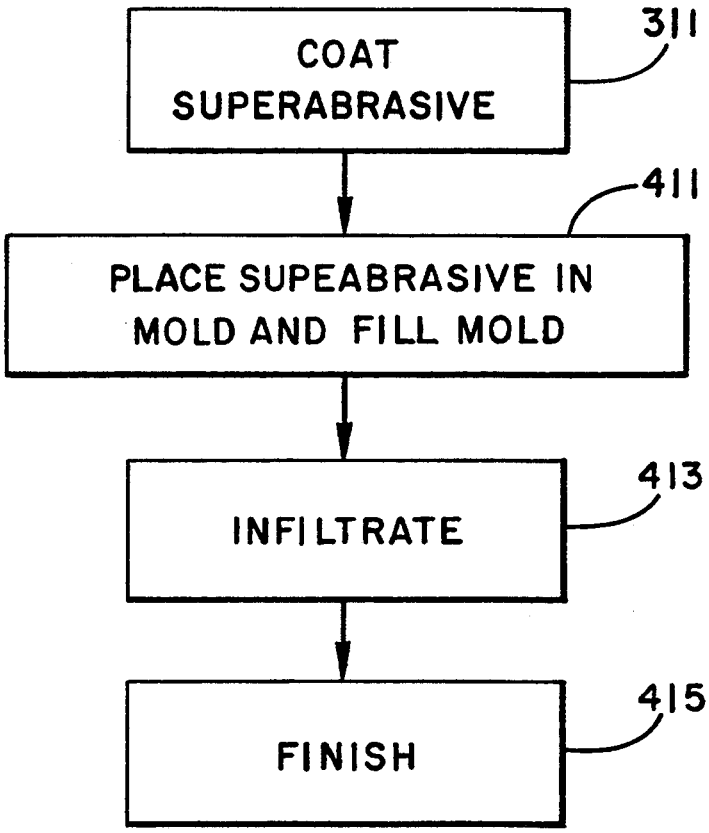
FIG. 19 is a flow diagram illustrating the steps in one method used to form the improved compacts which are used in the earth-boring bits of the invention.

With reference now to FIGS. 16 and 19, another preferred method of forming insert 211 according to the present invention will be discussed. The first step, represented by Block 311, is to coat superabrasive element 217. This step is accomplished as discussed above.

The next step in the method, represented by Block 411, and graphically illustrated in FIG. 16, is to place superabrasive element 217 in the bottom of a refractory mold 225. Refractory mold 225 is preferably formed of graphite, but any refractory mold material should be satisfactory. Next, refractory mold 225, containing superabrasive element 217, is filled with a fracture-tough matrix material particles 227. Preferably, fracture-tough matrix material particles 227 are tungsten carbide powder, but may be any conventional powder metallurgy material or mixture thereof. A quantity of solid binder material 229 then is placed atop fracture-tough matrix material particles 227.

Binder material 235 is a conventional infiltrant that is selected for its ability to wet both fracture-tough matrix material particles 227 and outer layer 223 of the coatings on superabrasive element 217. Like the brazing operation discussed above, binder material 229 should be selected to have a melting temperature not exceeding the maximum thermal stability temperature of superabrasive element 217, and not exceeding the melting point of the metal(s) of compliant layer 221. Of course, if only inner layer 219 is used (as in the case of smaller superabrasive elements 217) the brazing temperature need only not exceed the maximum temperature of thermal stability of element 217. Preferably, binder material 235 is an infiltration alloy comprising about 5 to 65% by weight manganese, up to about 35% by weight of zinc, and the balance copper.

The next step, represented by Block 413 of FIG. 19, is to place refractory mold 225 and its contents 217, 233, 235 into a furnace for infiltration. For the preferred materials described above, infiltration was carried out for approximately thirty minutes at 1000 degrees Celsius. Infiltration is a conventional process, and the materials and process temperatures may be varied, within the limitations described herein, to practice this method of the present invention successfully.

The final step of the method according to the present invention, represented by Block 415 of FIG. 19, is to finish insert 211. The finishing steps are performed to obtain an insert 211 of appropriate final dimension and geometry. Such finishing steps generally include those discussed with reference to FIG. 13.

Figure 17:
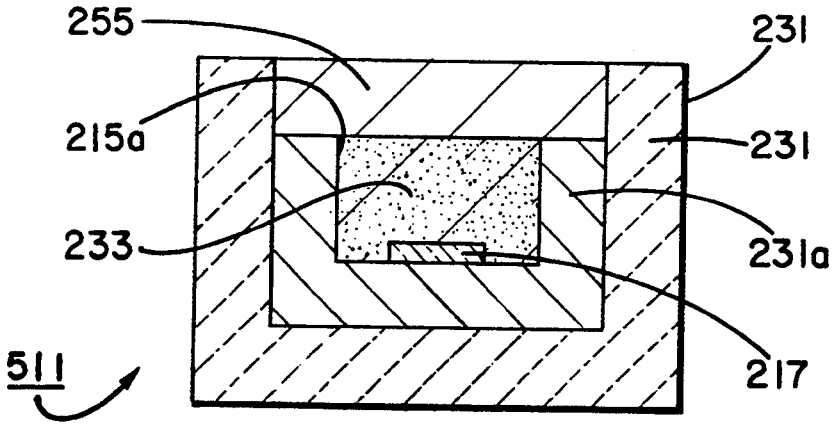
FIG. 17 is a schematic section view of an apparatus used to form compacts according to one embodiment of the invention.
Figure 20:
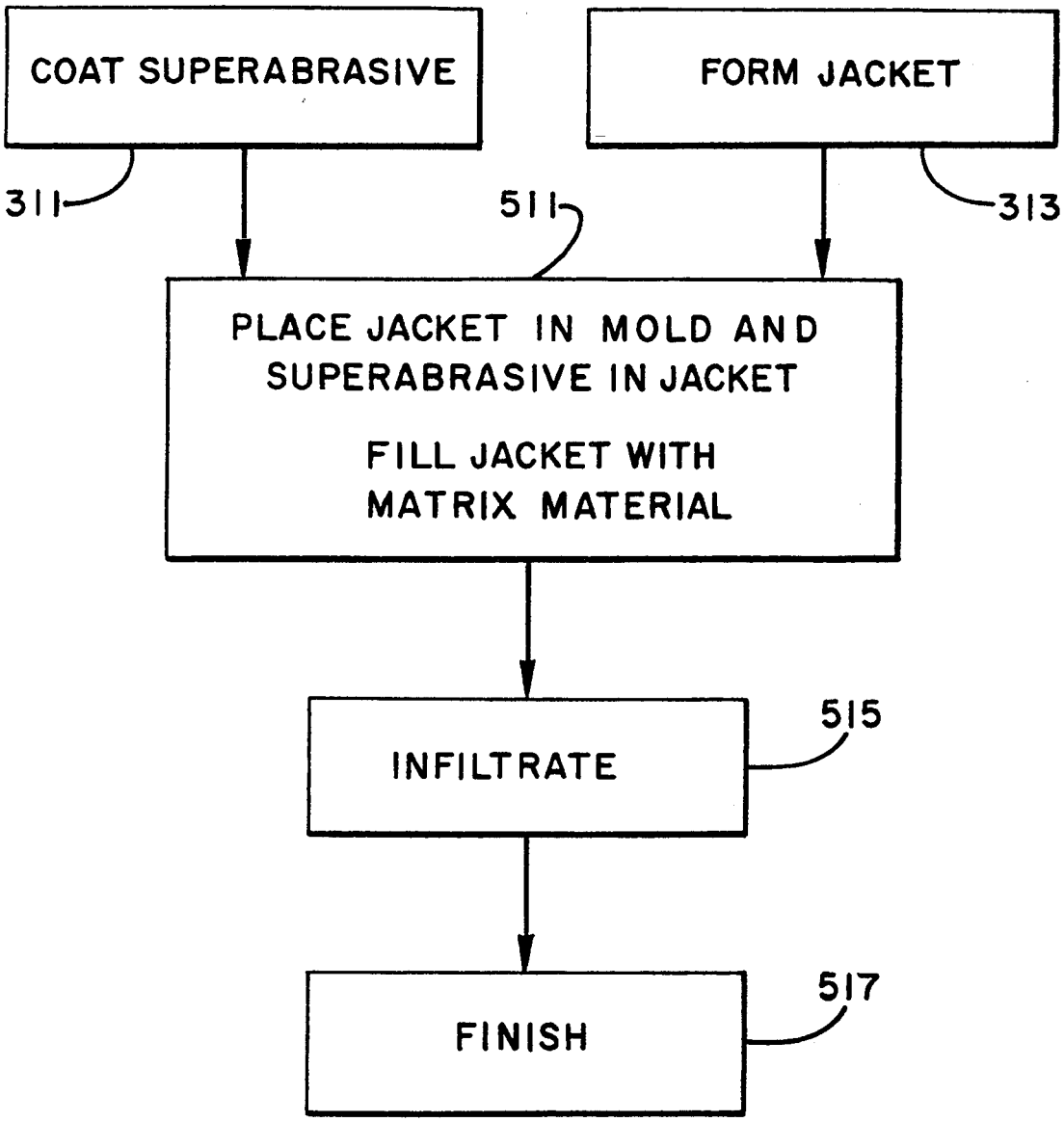
FIG. 20 is a flow diagram illustrating the steps in one method used to form the improved compacts which are used in the earth-boring bits of the invention.

FIGS. 17 and 20 illustrate yet another preferred method that may be employed to obtain an insert 211 according to the present invention. Again, the preliminary steps of the method, represented by Blocks 311 and 313 of FIG. 20, are to coat superabrasive 217, and to form hard metal jacket **213*a*. Superabrasive element 217 is coated as described above, and hard metal jacket 213*a* is formed substantially as described above. However, for reasons that will be appreciated, receptacle cavity 215*a* should be made larger than generally contemplated for use with the brazing method described with reference to FIG. 18**.

The next step of the preferred method, represented as Block 511 in FIG. 20, is graphically illustrated in FIG. 17. Hard metal jacket **213*a* is placed in a refractory mold 231 with receptacle cavity 215*a* facing upward. Refractory mold 231 preferably is formed of graphite, but any refractory material should be satisfactory. Superabrasive element 217 then is placed in the bottom of receptacle cavity 215*a* of hard metal jacket 213**.

Receptacle cavity **215*a*, containing superabrasive element 217, then is filled with fracture-tough matrix material particles 233. Fracture-tough matrix material 233 may be any suitable matrix material, but preferably is tungsten carbide. A quantity of binder material 235 then is placed in refractory mold 231 atop hard metal jacket 213** and its contents.

Binder material 235 is a conventional infiltrant that is selected for its ability to wet both fracture-tough matrix material particles 233 and outer layer 223 of the coatings on superabrasive element 217. Like the brazing operation discussed above, binder material 235 should be selected to have a melting temperature not exceeding the maximum thermal stability temperature of superabrasive element 217, and not exceeding the melting point of the metal(s) of compliant layer 221. Of course, if only inner layer 219 is used (as in the case of smaller superabrasive elements 217) the brazing temperature need only not exceed the maximum temperature of thermal stability of element 217. Preferably, binder material 235 is an infiltration alloy comprising about 5 to 65% by weight manganese, up to about 35% by weight of zinc, and the balance copper.

The next step, represented by Block 515 of FIG. 20, is to place refractory mold 231 and its contents 213*a*, 217, 233, 235 into a furnace for infiltration. For the preferred materials described above, infiltration was carried out for approximately thirty minutes at 1000 degrees Celsius. Infiltration is a conventional process, and the materials and process temperatures may be varied, within the limitations described herein, to practice this method of the present invention successfully.

The final step of the method according to the present invention, represented by Block 517 of FIG. 20, is to finish insert 211. The finishing steps are performed to obtain an insert 211 of appropriate final dimension and geometry. Such finishing steps generally include those discussed with reference to FIG. 13.

The end result of the foregoing methods, discussed with reference to FIGS. 16, 17, 18, 19 and 20, is an insert for use in earth-boring bits of the rolling cone variety substantially as described with reference to FIG. 15. In each of the three preferred methods described herein, the brazing or infiltration step provides an elevated temperature at which the mechanical and metallurgical bonds between superabrasive element 217, layers of metallic material 219, 221, 223 (or simply 219), binder material, and the material of hard metal jacket 213 can occur. However, this elevated temperature is relatively low compared to the high-temperature, high-pressure process described herein.

According to the brazing method described herein, hard metal jacket 213 is formed entirely of cemented carbide or equivalent material. According to the infiltration method described herein, hard metal jacket is formed of a combination of cemented carbide and infiltrated matrix particles, or infiltrated matrix alone.

The resulting compact or insert 211 is provided with a working surface, a majority of which is superabrasive, that is surrounded at its periphery by the fracture-tough material of hard metal jacket 213 to insulate the peripheral edge of superabrasive element 217 from transient or shock loads during operation of the earth-boring bit. It will be appreciated that, immediately after manufacture, the exposed superabrasive surface may be covered by the layers of metallic material 219, 221, 223 (or 219 alone). However, these materials are so thin that, in operation, they will be eroded away quickly, leaving a working surface of superabrasive material.

An invention has been provided with several advantages. The method of the invention can be used to manufacture an improved earth-boring bit which features novel superabrasive compacts as wear-resistant inserts. The wear-resistant inserts utilized in the bits of the invention are provided as substantially all diamond material with only a jacket of hard metal to facilitate machining and mounting of the inserts in the drill bit face. By manufacturing compacts having only thin surrounding jackets of hard metal and substantially superabrasive cores, improved wear resistance and life can be obtained over standard tungsten carbide inserts or the diamond coated compacts of the past such as standard stud-mounted PDC inserts. The use of such inserts in the gage and heel rows of rolling cone bits has been found to extend the useful life of such bits.

The insert manufactured according to the brazing or infiltration methods described herein has significant advantages even over those manufactured according to the high-temperature, high-pressure method described herein. Conventional, commercially available superabrasive elements may be used with the insert or compact according to the low-temperature, low-pressure method. Further, the need for expensive and complex high-temperature, high-pressure forming apparatus is obviated. Still further, the compacts or inserts manufactured according to the low-temperature, low-pressure method may be formed nearer final dimension, thus reducing expense and time associated with finishing operations. An economical insert having a superabrasive working surface surrounded by a hard metal jacket, which facilitates machining and mounting of the inserts in the earth-boring bit, and protects the superabrasive from rapid degradation in drilling operation of the bit, is provided.

While the invention has been shown in only one of its forms, it is not thus limited but is susceptible to various changes and modifications without departing from the spirit thereof.

We claim:

1. A method of forming a insert for use in an earth-boring bit having a body and at least one bearing shaft depending therefrom, at least one cutter cone mounted for rotation on the bearing shaft, the cutter cone having a plurality of sockets formed therein to receive the insert by interference fit, the method comprising the steps of:

selecting at least one superabrasive element having desired wear-resistant properties and a maximum temperature of thermal stability;

coating at least a portion of the superabrasive element with at least one layer of metallic material;

forming a hard metal jacket of fracture-tough material;

providing the hard metal jacket with an opening at a selected end thereof to define a receptacle cavity therein; and securing the superabrasive element in the receptacle cavity of the hard metal jacket by introducing a binder material therebetween, the step of securing serving to establish both mechanical and metallurgical bonds between the superabrasive element, the at least one layer of metallic material, the binder material, and the fracture-tough material of the hard metal jacket.

2. The method according to claim 1, wherein the step of securing the superabrasive element in the receptacle cavity of the hard metal jacket further comprises the steps of:

placing the coated superabrasive element in the receptacle cavity of the hard metal jacket;

filling the receptacle cavity with particles of fracture-tough matrix material; and infiltrating the coated superabrasive element and the particles of fracture-tough matrix material with the binder material at a temperature less than the maximum temperature of thermal stability of the superabrasive element.

3. The method according to claim 1 wherein the step of securing the superabrasive element in the receptacle cavity further comprises the steps of:

placing the coated superabrasive element in the receptacle cavity of the hard metal jacket; and brazing the superabrasive therein with a binder material at a temperature less than the maximum temperature of thermal stability of the superabrasive element.

4. The method according to claim 1 wherein the step of coating the superabrasive element further comprises the step of depositing an inner layer of metallic material on the superabrasive element by chemical vapor deposition.

5. The method according to claim 1 wherein the step of coating the superabrasive element further comprises the step of depositing a compliant layer of ductile metallic material on the superabrasive element by electroplate deposition.

6. The method according to claim 1 wherein the step of coating the superabrasive element further comprises the step of depositing an inner layer of metallic material on the superabrasive element by metal vapor deposition.

7. The method according to claim 1 wherein the step of coating the superabrasive element further comprises the step of depositing a compliant layer of ductile metallic material on the superabrasive element by electroless deposition.

8. The method according to claim 1 wherein the step of coating the superabrasive element further comprises the step of depositing an outer layer of metallic material on the superabrasive element by chemical vapor deposition.

9. The method according to claim 1 wherein the step of coating the superabrasive element further comprises the step of depositing an outer layer of metallic material on the superabrasive element by metal vapor deposition.

10. A method of forming a insert for use in an earth-boring bit having a body, at least one bearing shaft depending downwardly and inwardly therefrom, and at least one cutter cone mounted for rotation on the bearing shaft, the cutter cone having a plurality of sockets formed therein to receive the gage insert by interference fit, the method comprising the steps of:

selecting at least one superabrasive element having desired wear-resistant properties, and having a maximum temperature of thermal stability;

coating the superabrasive element with at least one layer of metallic material;

placing the coated superabrasive element in a mold;

filling the mold with particles of fracture-tough matrix material; and infiltrating the coated superabrasive and the particles of fracture-tough matrix material with a binder material at a temperature less than the melting temperature of the at least one layer and less than the maximum temperature of thermal stability of the superabrasive element, the step of infiltrating serving to establish both mechanical and metallurgical bonds between the superabrasive element, the at least one layer of metallic material, the binder material, and the fracture-tough matrix material.

11. The method according to claim 9 wherein the step of coating the superabrasive element further comprises the step of depositing an inner layer of metallic material on the superabrasive element by chemical vapor deposition.

12. The method according to claim 9 wherein the step of coating the superabrasive element further comprises the step of depositing an inner layer of metallic material on the superabrasive element by metal vapor deposition.

13. The method according to claim 9 wherein the step of coating the superabrasive element further comprises the step of depositing a compliant layer of ductile metallic material on the superabrasive element by electroplate deposition.

14. The method according to claim 9 wherein the step of coating the superabrasive element further comprises the step of depositing a compliant layer of ductile metallic material on the superabrasive element by electroless deposition.

15. The method according to claim 9 wherein the step of coating the superabrasive element further comprises the step of depositing an outer layer of metallic material on the superabrasive element by chemical vapor deposition.

16. The method according to claim 9 wherein the step of coating the superabrasive element further comprises the step of depositing an outer layer of metallic material on the superabrasive element by metal vapor deposition.

* * * * *